US009456700B2

(12) United States Patent
Greener

(10) Patent No.: US 9,456,700 B2
(45) Date of Patent: Oct. 4, 2016

(54) BED APPARATUS

(71) Applicant: Mark Greener, Curtice, OH (US)

(72) Inventor: Mark Greener, Curtice, OH (US)

(73) Assignee: BEDAIR BREEZE LLC, Curtice, OH (US)

( * ) Notice: Subject to any disclaimer, the term of this patent is extended or adjusted under 35 U.S.C. 154(b) by 0 days.

(21) Appl. No.: 14/672,691

(22) Filed: Mar. 30, 2015

(65) Prior Publication Data

US 2015/0272338 A1 Oct. 1, 2015

Related U.S. Application Data

(60) Provisional application No. 61/973,533, filed on Apr. 1, 2014.

(51) Int. Cl.

| | |
|---|---|
| ***A47C 27/00*** | (2006.01) |
| ***A47C 21/04*** | (2006.01) |
| *A47C 21/02* | (2006.01) |

(52) U.S. Cl.

CPC ..... *A47C 21/044* (2013.01); *A47C 21/024* (2013.01); *A47C 21/02* (2013.01); *A47C 21/022* (2013.01); *A47C 21/04* (2013.01); *A47C 21/042* (2013.01)

(58) Field of Classification Search

CPC .. A47C 21/044; A47C 21/024; A47C 21/04; A47C 21/042; A47C 21/022; A47C 21/02

See application file for complete search history.

(56) References Cited

U.S. PATENT DOCUMENTS

| | | | | | |
|---|---|---|---|---|---|
| 597,805 | A * | 1/1898 | Lownes | A47C 21/022 | 24/332 |
| 1,891,903 | A * | 12/1932 | Bang | A47C 21/044 | 5/284 |
| 2,186,142 | A * | 1/1940 | Lieberman | A47C 21/044 | 415/148 |
| 2,461,432 | A * | 2/1949 | Mitchell | A47C 21/044 | 4/529 |
| 3,101,488 | A * | 8/1963 | Peebles | A47C 21/044 | 5/284 |
| 3,230,556 | A * | 1/1966 | Shippee | A47C 21/044 | 392/379 |

(Continued)

*Primary Examiner* — David E Sosnowski
*Assistant Examiner* — Morgan McClure
(74) *Attorney, Agent, or Firm* — Fraser Clemens Martin & Miller LLC; Jacob M. Ward

(57) ABSTRACT

A bed apparatus has a housing with an intake duct, a closeable vent, and an exhaust port. The intake duct is configured to intake air from an area outside of a bed. The closeable vent is configured to selectively supply the air to the bed. The exhaust port is configured to selectively return the air to the area outside of the bed. At least one electric fan is disposed within the housing between the closeable vent and the intake duct. In operation, the bed apparatus can be switched from a sound-enrichment-only function, to a sound-enrichment-and-bed-air-delivery function, simply by closing and opening the vent, respectively. The bed apparatus may further include a clamp for securing a bed cover above the housing.

17 Claims, 9 Drawing Sheets

(56) References Cited

U.S. PATENT DOCUMENTS 3,345,654 A * 10/1967 Noble ..... A47C 21/024 5/505.1
3,803,645 A * 4/1974 Oliverius ..... A47C 20/00 297/423.4
4,937,903 A * 7/1990 Joly ..... A47C 21/044 5/284
4,939,804 A * 7/1990 Grant ..... A47C 21/044 5/423
5,081,730 A * 1/1992 Moody ..... A47C 21/022 24/457
5,175,899 A * 1/1993 Lou ..... A47C 20/022 5/421
5,299,428 A * 4/1994 Kawaguri ..... A47C 21/044 236/91 C
5,404,602 A * 4/1995 Kondo ..... A47C 21/022 24/499
5,438,720 A * 8/1995 Daneshvar ..... A47C 20/021 5/424
5,730,120 A * 3/1998 Yonkers, Jr. ..... A47C 21/048 128/202.13
5,787,534 A * 8/1998 Hargest ..... A47D 15/001 297/180.11
6,052,853 A * 4/2000 Schmid ..... A47C 21/044 5/423
6,363,551 B1 * 4/2002 Flores ..... A47C 21/044 5/421
7,037,188 B2 5/2006 Schmid et al.
7,487,646 B2 2/2009 Matsushima et al.
7,543,583 B2 * 6/2009 Acton ..... A47C 21/044 128/200.28
7,631,377 B1 * 12/2009 Sanford ..... A47C 21/044 5/413 R
7,913,332 B1 * 3/2011 Barnhart ..... A47C 21/044 5/421
7,996,938 B1 * 8/2011 Calmes ..... A47C 21/024 5/504.1
8,122,540 B2 2/2012 Ardis
8,191,187 B2 * 6/2012 Brykalski ..... A47C 21/044 297/180.13
2003/0140418 A1 * 7/2003 Klamm ..... A47C 21/048 5/423
2004/0242148 A1 * 12/2004 Schmid ..... A47C 21/044 454/329
2005/0003755 A1 * 1/2005 Koessler ..... F24F 13/08 454/359
2005/0199736 A1 * 9/2005 Matsushima ..... A47C 19/005 236/49.3
2005/0278863 A1 * 12/2005 Bahash ..... A01K 1/0353 5/726
2006/0010577 A1 * 1/2006 Sarikelle ..... A41C 3/144 2/267
2006/0025067 A1 * 2/2006 Koessler ..... F24F 7/02 454/359
2008/0060131 A1 * 3/2008 Tompkins ..... A47C 21/048 5/423
2010/0005588 A1 * 1/2010 Christopher ..... A47C 21/003 5/423
2011/0264275 A1 * 10/2011 Thomle ..... F24F 11/006 700/276
2011/0271449 A1 * 11/2011 Ardis ..... A47C 21/044 5/423
2012/0172959 A1 * 7/2012 Lachenbruch ..... A41D 19/0037 607/111
2013/0031722 A1 * 2/2013 Wong ..... A47C 21/048 5/423
2013/0143480 A1 * 6/2013 Trevelyan ..... A47C 21/044 454/284
2014/0011440 A1 * 1/2014 Savchenko ..... F24F 13/20 454/367
2014/0060795 A1 * 3/2014 Yu ..... B60H 1/00821 165/202
2014/0283301 A1 * 9/2014 Whaley ..... A47C 21/022 5/496
2015/0068609 A1 * 3/2015 Aramli ..... A47C 21/044 137/2
2015/0074904 A1 * 3/2015 Aramli ..... A47C 21/042 5/421
2015/0265061 A1 * 9/2015 Spaugh ..... A61G 13/1245 5/505.1

* cited by examiner

BED APPARATUS

CROSS-REFERENCE TO RELATED APPLICATIONS

This application claims the benefit of U.S. Patent Application No. 61/973,533 filed on Apr. 1, 2014. The entire disclosure of the above application is hereby incorporated herein by reference.

FIELD

The invention relates to beds and, more particularly, to a bed apparatus selectively providing ventilation and/or sound enrichment to a bed.

BACKGROUND

Sleep is an important and necessary part of a person's daily routine. Insufficient or poor sleep can have both short-term consequences such as reduced alertness and concentration, and long-term consequences like heart disease and stroke. Many factors can lead to a poor night of sleep, including internal factors like stress or sickness, and external factors like noise, improper temperature, or an uncomfortable sleeping surface, as examples.

Aware of the consequences of poor sleep, consumers often spend thousands of dollars on external factors to maximize comfort. These expenditures may include improving the comfort of the bed by adding special mattresses, pillows, and blankets. Consumers may also improve the sleeping environment by adjusting the room temperature, muffling or cancelling out disturbing noises, or blocking undesired light from entering the room.

One means of improving the sleeping environment involves supplying a flow of air to the sleeping area to make the sleeping climate more comfortable to the user. For example, a ceiling fan or a room fan may be used to circulate air in a room. It is also known in the art to place a ventilation system near a bed, or under bed covers, to provide a flow of air either over or under the bed covers. However, existing ventilation systems are independent from the bed, and must be installed by the user. Additionally, these ventilation systems can take away from the aesthetics of the bedroom, as they require additional apparatuses to be placed on or near the bed.

Another shortcoming of existing ventilation systems is that they are configured to provide a flow of air either over the top of the bed covers, or underneath the bed covers, but cannot be easily converted by the user to provide only sound enrichment, i.e., the provision of desirable background or "white noise" that facilitates sleep. Sound enrichment cancels out sleep disturbing noises external to the sleeping environment, such as noisy streets or neighbors. However, if the user does not desire a circulation or supply of air in known ventilation systems, the fan or ventilation system must be turned off or moved away from the sleeping area, mitigating the beneficial sound-enrichment provided by the ventilation system.

There is a continuing need in the art for a bed apparatus that selectively provides a flow of air and sound enrichment, or only sound enrichment.

SUMMARY

In concordance with the instant disclosure, a bed apparatus that selectively provides a flow of air and sound enrichment, or only sound enrichment, has surprisingly been discovered.

In one embodiment, a bed apparatus includes a housing and at least one electric fan. The housing has an intake duct, a closeable vent, and an exhaust port. The intake duct is configured to intake air from an area outside of a bed. The closeable vent is configured to selectively supply the air to the bed. The exhaust port is configured to selectively return the air to the area outside of the bed. The at least one electric fan is disposed within the housing between the closeable vent and the intake duct. The housing is selectively adjustable from a sound-enrichment-and-bed-air mode to a sound-enrichment-only mode. In the sound-enrichment-and-bed-air mode, the closeable vent is in an open position and the air is expelled through the closeable vent to the bed. In the sound-enrichment-only mode, the closeable vent is in a closed position and air is expelled through the exhaust port away from the bed.

In another embodiment, the housing of the bed apparatus is disposed through a footboard of the bed. The footboard has an inboard surface and an outboard surface. The intake duct has a check valve disposed therein, and a downwardly oriented inlet disposed adjacent the outboard surface of the footboard. The check valve within the intake duct militates against a reverse flow of air toward the intake duct from the at least one electric fan. The closeable vent is disposed adjacent the inboard surface of the footboard, and also has a switch for selectively opening and closing the closeable vent. The exhaust port has an outlet that is disposed adjacent the outboard surface of the footboard. The exhaust portal also has a damper disposed therein. The damper militates against a flow of air through the exhaust port where the closeable vent is in the open position. The damper also permits the flow of air through the exhaust port where the closeable vent is in the closed position. A clamp is further disposed above the closeable vents of the housing and configured to hold an end of a cover on the bed above the closeable vent. This ensures that the air is provided to the occupant of the bed underneath the cover in operation, when the closeable vent of the bed apparatus is in the open position.

In a further embodiment, the housing of the bed apparatus is configured for attachment to the inboard surface of the footboard of the bed with at least one slidable rail. The slidable rail permits a height adjustment of the housing relative to the bed. The exhaust port may have a downwardly oriented outlet that is disposed at an end of the housing. The bed apparatus can further have a lower air pressure seal. The lower air pressure seal is attached to the housing below the closeable vent, for example, by being disposed in a channel formed in the housing. The lower air pressure seal works in conjunction with the clamp disposed above the housing to ensure that the air is provided to the occupant of the bed underneath the cover, when the closeable vent of the bed apparatus is in the open position and the electric fan is operating.

BRIEF DESCRIPTION OF THE DRAWINGS

The above, as well as other objects and advantages of the disclosure, will become readily apparent to those skilled in the art from reading the following detailed description of various embodiments of the disclosure when considered in the light of the accompanying drawings in which.

DETAILED DESCRIPTION

Figure 1:
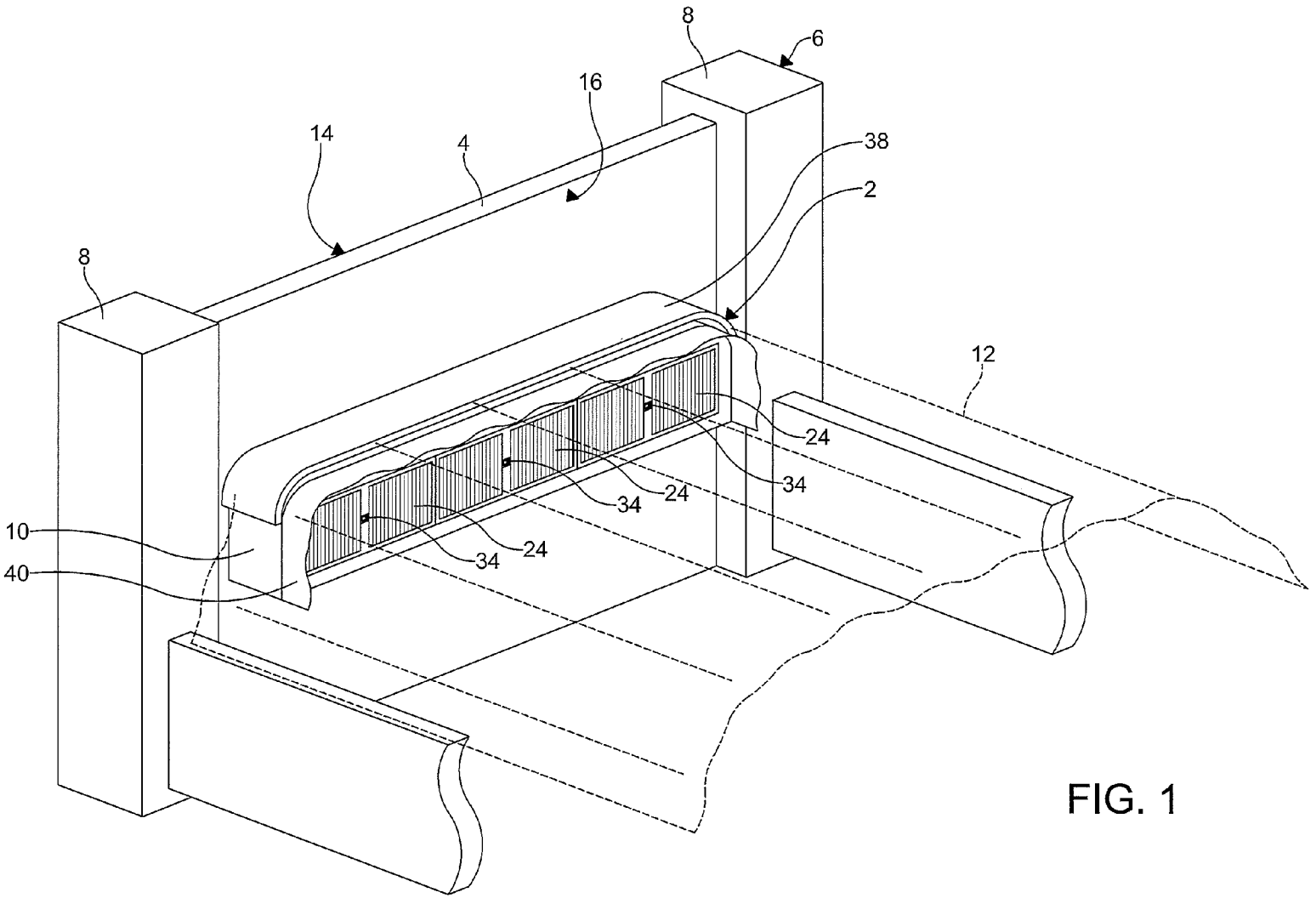
FIG. 1 is a front perspective view of a bed apparatus according to one embodiment of the instant disclosure, the bed apparatus depicted with a housing disposed through a foot board of a bed, and an end of a bed cover clamped to the housing of the bed apparatus.

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical unless otherwise disclosed.

FIGS. 1-6 show a bed apparatus 2 according to one embodiment of the present disclosure. In FIGS. 1-6, the bed apparatus 2 is integral with a bed footboard. It should be understood that, in other embodiments shown in FIGS. 7-11, the bed apparatus 2 of the present disclosure may also be provided in the form of a kit for attachment to the bed footboard. Thus, the bed apparatus 2 of the present disclosure is not limited to the integrally-formed embodiments and features shown in FIGS. 1-6.

The bed apparatus 2 shown in FIGS. 1-6 may be disposed through a footboard 4, which in turn is disposed between a pair of bed posts 8 at one end of the bed 6. The bed apparatus 2 has a housing 10 that is configured to hold an end of a cover 12, such as a sheet or comforter, which is placed on the bed 6.

The housing 10 of the present disclosure is selectively adjustable from a sound-enrichment-and-bed-air mode to a sound-enrichment-only mode. In the sound-enrichment-and-bed-air mode, the bed apparatus 2 provides both air under the cover 12 and a comforting level of background- or white-noise to an occupant of the bed 6. In the sound-enrichment-only mode, the bed apparatus 2 provides only the comforting level of background- or white-noise to the occupant of the bed 6 without also providing the air under the cover 12.

The footboard 4 of the bed 6 has an outboard surface 14 and an inboard surface 16. The housing 10 defines an air flow passage 18 through both the outboard surface 14 and the inboard surface 16 of the footboard 4. The air flow passage 18 permits a selective flow of air to the occupant of the bed 6 where the bed apparatus 2 is operated in the sound-enrichment-and-bed-air mode.

Figure 2:
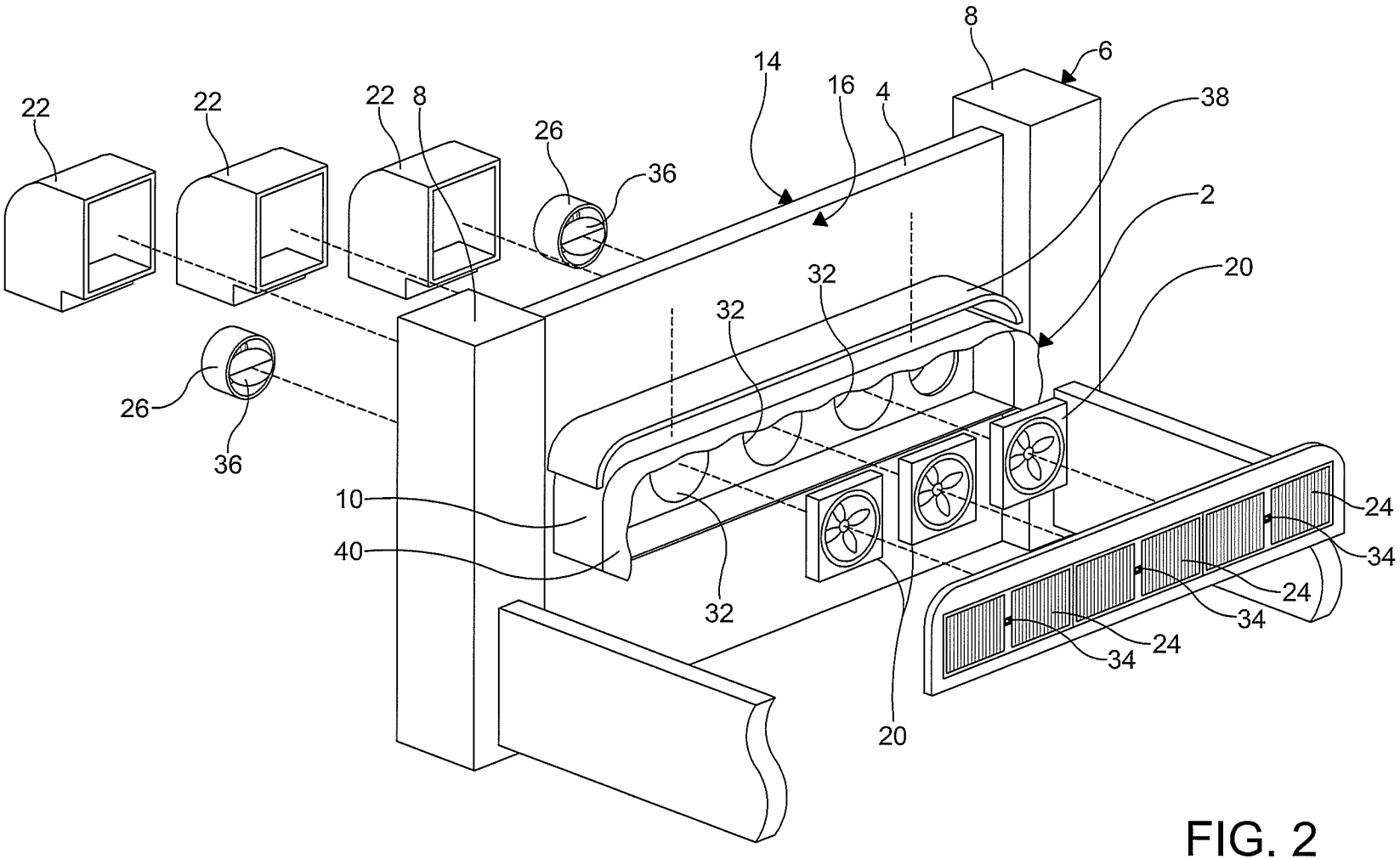
FIG. 2 is an exploded front perspective view of the bed apparatus shown in FIG. 1, the bed apparatus depicted without the bed cover.
Figure 3:
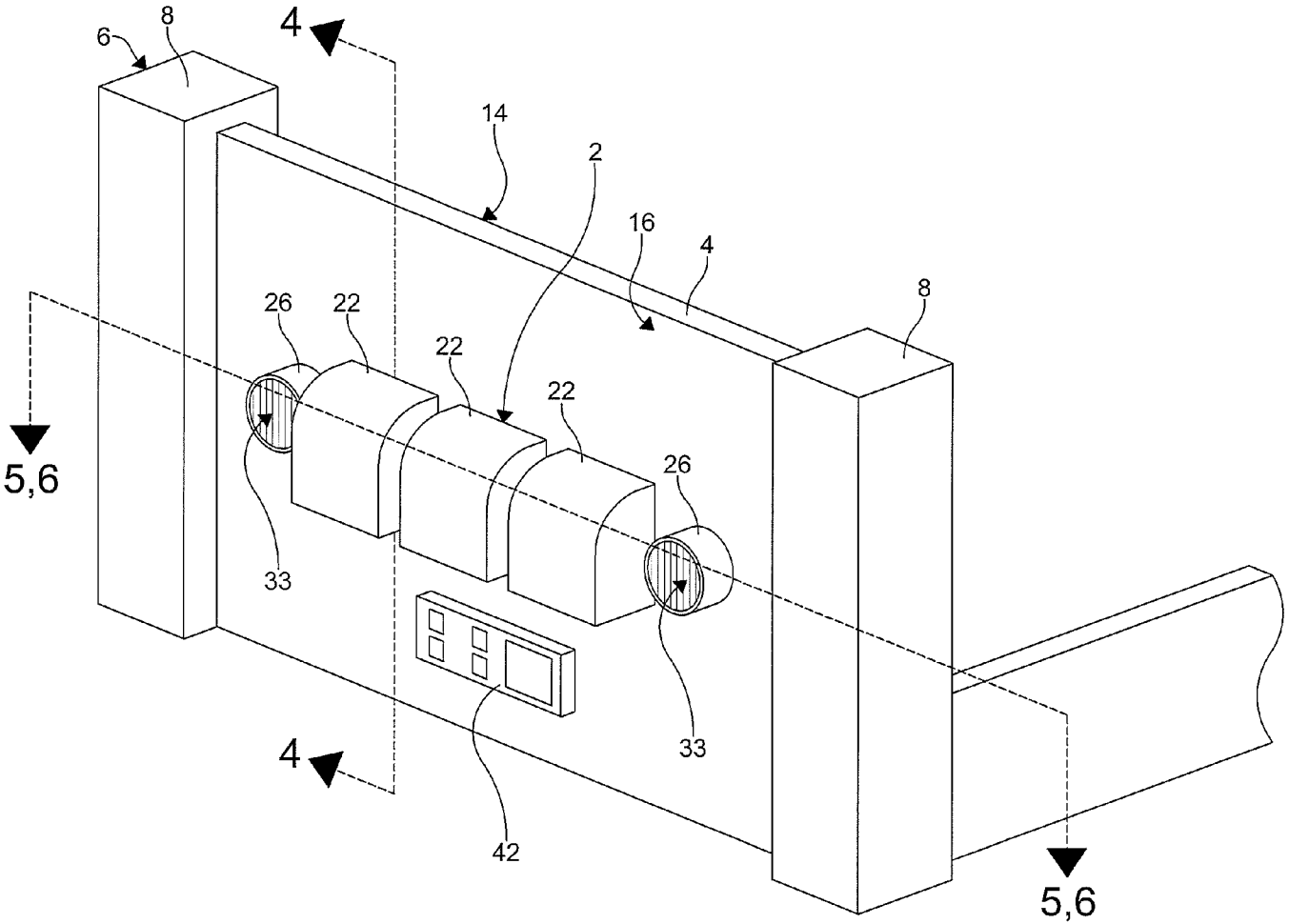
FIG. 3 is a rear perspective view of the bed apparatus shown in FIG. 1.
Figure 5:
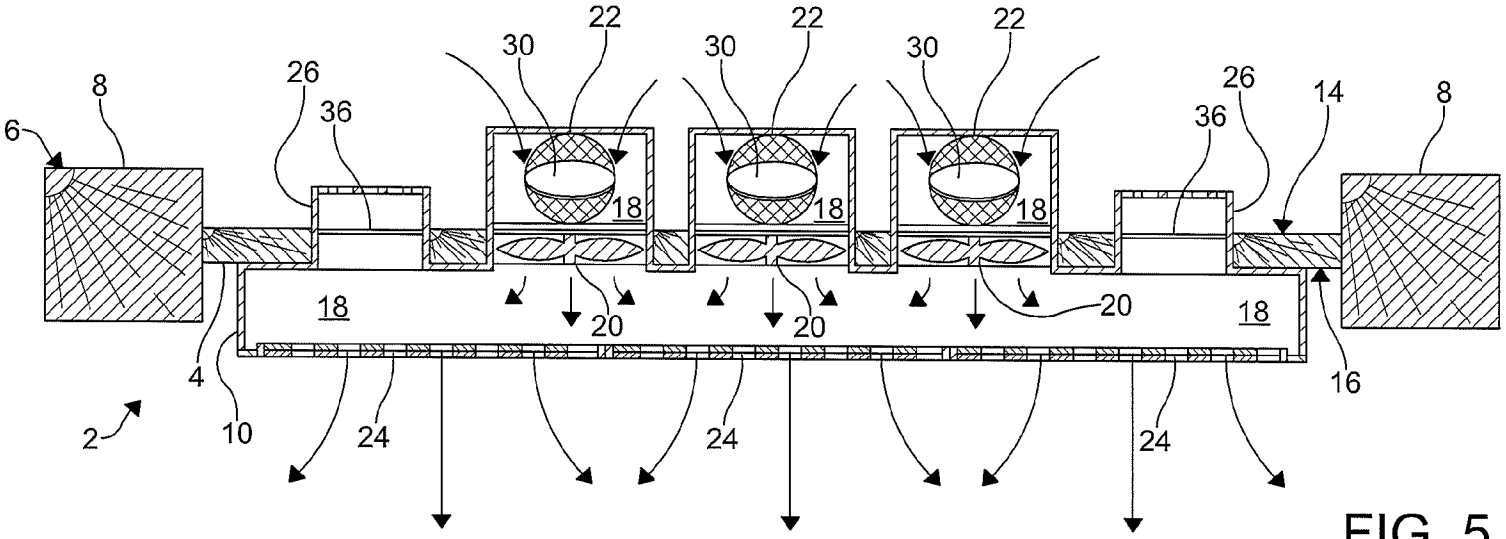
FIG. 5 is a top plan cross-sectional view of the bed apparatus taken along section line 5,6-5,6 in FIG. 3, and depicting with arrowed lines the air flow through the bed apparatus in a sound-enrichment-and-bed-air mode.
Figure 6:
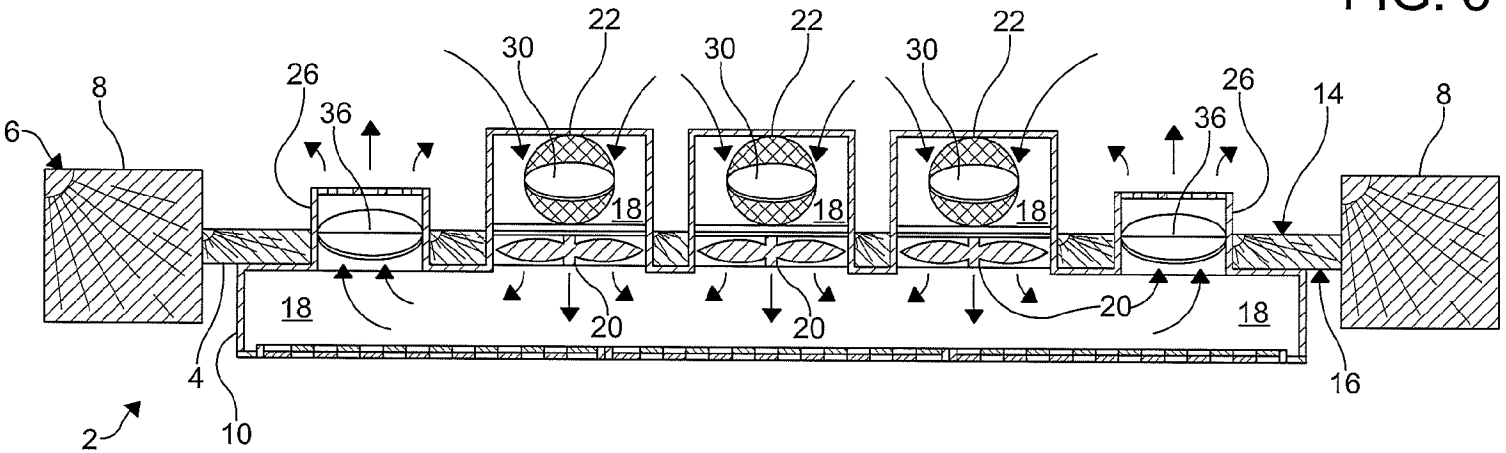
FIG. 6 is a top plan cross-sectional view of the bed apparatus taken along section line 5,6-5,6 in FIG. 3, and depicting with arrowed lines the air flow through the bed apparatus in a sound-enrichment-only mode.

As shown in FIGS. 2 and 5-6, the housing 10 also contains at least one electric fan 20 configured to cause the air flow through the air flow passage 18 when in operation. The electric fan 20 is disposed in the air flow passage 18 of the housing 10. The electric fan 20 is selected to provide an aesthetically pleasing level of background- or white-noise. The acceptable noise intensity provided by the electric fan 20 may be between about 10 and 50 decibels, more particularly between about 20 and 40 decibels, and most particularly about 30 decibels. One of ordinary skill in the art may select the number of fans 20, and suitable placement and types of the electric fan 20, within the scope of the present disclosure.

With renewed reference to FIGS. 1-6, the housing 10 of the bed apparatus 2 has an intake duct 22, a closeable vent 24, and an exhaust port 26. The intake duct 22 is configured to intake air from an area surrounding the bed 6, for example, the ambient atmosphere outside of the bed 6. The closeable vent 24 is configured to selectively supply the air to the bed 6. The exhaust port 26 is configured to selectively return the air to the area outside of the bed 6.

Figure 4:
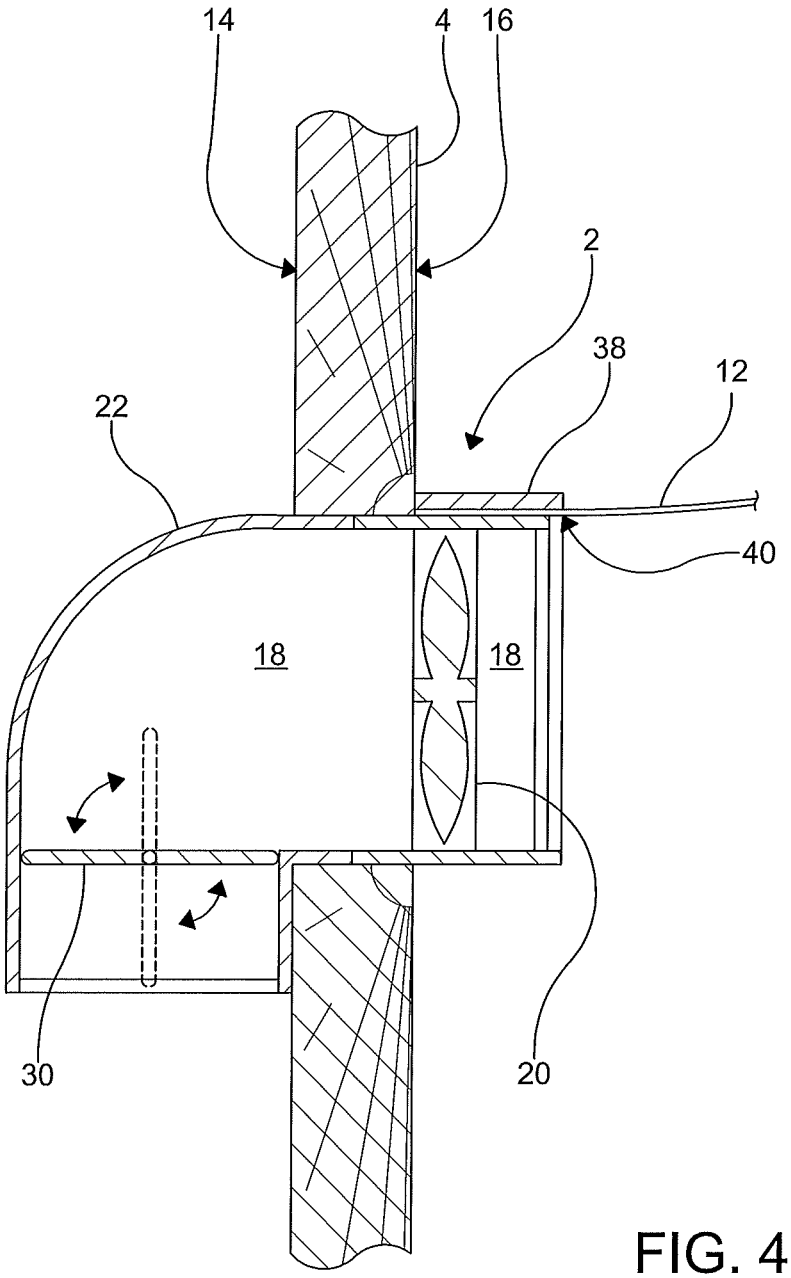
FIG. 4 is a side elevational cross-sectional view of the bed apparatus taken along section line 4-4 in FIG. 3, and depicting a damper valve disposed within the housing.

As shown in FIG. 4, the intake duct 22 of the present disclosure has an inlet 28 that is disposed adjacent the outboard surface 14 of the footboard 4. The air flow conduit 18 may include a plurality of independent intake ducts 22, each intake duct 22 having a unique inlet 28 adjacent the outboard surface 14 of the housing 10. It should also be appreciated that, in an alternative embodiment not shown, a plurality of intake ducts 22 may be in fluid communication with a single inlet 24, as desired.

In the illustrated embodiment of FIGS. 1-6, each of the inlets 28 has a substantially downward orientation. The downward orientation of the inlet 28 advantageously conceals the inlet 28 from potential obstructions, thereby allowing air flow to pass through the inlet 28 uninterrupted. However, it should be understood that the inlet 28 may be oriented in any suitable manner to provide communication of air to the air flow passage 18 of the housing 10, as desired.

Referring to FIGS. 2 and 4-6, the intake duct 22 may further have a check valve 30 disposed therein. The check valve 30 militates against a reverse flow of air toward the inlet 28 of the intake duct 22 from the electric fan 20 disposed in the air flow passage 18. The check valve 30 allows unidirectional airflow therethrough, wherein air can flow from the inlet 28 to the electric fan 20, but cannot flow from the electric fan 20 to the inlet 28. As a nonlimiting example, the check valve 30 may be a plate or damper valve rotatably disposed inside of the intake duct 22. However, any other suitable type of check valve 30 may also be employed, as desired.

In a particular embodiment shown in FIG. 4, the electric fan 20 is positioned downstream of the inlet 28 of the intake duct 22. For example, the electric fan 20 is disposed adjacent an outlet 32 of the intake duct 22. The electric fan 20 may cover the outlet 32 of the intake duct 22 such that all air from the intake duct 22 passes through the electric fan 20. Where the electric fan 20 is positioned thusly, the check valve 30 may likewise be disposed between the inlet 28 and the electric fan 20. It should be appreciated that other locations for the electric fan 20 and the check valve 30 in the air flow passage 18 of the housing 10 may also be employed, as desired.

As shown in FIGS. 1-2, the closeable vent 24 of the present disclosure is disposed adjacent the inboard surface 16 of the footboard 4 of the bed 6. The closeable vent 24 may have a switch 34 for selectively opening and closing the closeable vent 24. The switch 34 may be a lever or dial for moving the closeable vent 24 to one of the open position and the closed position by a manual movement of the switch 34. For example, the closeable vent 24 may be a louvered grate. In another example, the closeable vent 24 may be a pair of slidable plates with openings that may be transitioned into, and out of, alignment by a lateral movement of one of the plates relative to the other of the plates. In a further example, the closeable vent 24 may be connected to an actuator such as an electric motor, which can be manually operated by means of an electric switch 34. Other suitable types of closeable vents 24 and switches 34 may also be used by a skilled artisan within the scope of the disclosure.

Referring now to FIGS. 2-6, the exhaust port 26 of the present disclosure has an outlet 33 that is disposed adjacent to the outboard surface 14 of the footboard 4 of the bed 6. The exhaust port 26 may have a damper 36. The damper 36 militates against a flow of air through the exhaust port 26 where the closeable vent 24 is in the open position, and permits the flow of air through the exhaust port 26 where the closeable vent 24 is in the closed position. The damper 36 may be the same as, similar to, or different from the structure of the check valve 30. For example, the damper 36 may be a plate or damper valve rotatably disposed inside of the exhaust port 26. One of ordinary skill in the art may select other suitable types of dampers 36, as desired.

In particular embodiments, a pair of the exhaust ports 26 are in fluid communication with a plurality of the intake ducts 22, and also with a plurality of the closeable vents 24. The closeable vents 24 are configured to expel air away from the inboard surface 16 of the footboard 4, and toward the bed occupant, when in an open position. The open position of the closeable vents 24 thereby places the bed apparatus 2 in the sound-enrichment-and-bed-air mode while the at least one electric fan 20 is operating, for example, as shown in FIG. 5. Advantageously, where the closeable vents 24 are in a closed position, the exhaust ports 26 are configured to expel air away from the outboard surface 14 of the footboard 4, and away from the bed occupant. The closed position of the closeable vents 24 thereby places the bed apparatus 2 in the sound-enrichment-only mode while the at least one electric fan 20 is operating, for example, as shown in FIG. 6.

The bed apparatus 2 of the present disclosure is also configured to efficiently deliver and direct the air from the bed apparatus 2 to the occupant of the bed 6, by holding the bed cover 12 in place above the closeable vents 24. In particular, the bed apparatus 2 may have a clamp 38 for holding the end of the bed cover 12. The clamp 38 may be disposed above the housing 10. In one example, illustrated in FIGS. 1-2, the clamp 38 may be in the form of a clamp board that conforms substantially to the shape of an upper surface of the housing 10. In operation, the end of the bed cover 12 is disposed between the clamp board and the upper surface, and is held firmly in place, for example, by friction fit between the clamp board and the housing 10. Other fasteners such as screw, bolts, pins, or the like may also be employed to secure the clamp board to the housing 10 within the scope of the disclosure.

In other examples, the clamp 38 is provided in the form of spring-loaded clips (not shown) attached to the upper surface of the housing 10. The spring-loaded clips may be biased toward the upper surface so that the end of the bed cover 12 may be held securely in place by the clips. In further examples, the clamp 38 is provided in the form of a C-channel (not shown) that has a friction fit with a rib (not shown) formed on the upper surface of the housing. The end of the bed cover 12 may also be disposed between the C-channel and the rib in order to hold the end of the bed cover 12 in place on the housing 10. One of ordinary skill in the art may also select other suitable structures for holding the end of the bed cover 12 on the housing 10 above the closeable vents 24, as desired.

With renewed reference to FIGS. 1-2, the bed apparatus 2 may further have a flexible toe guard 40. The flexible toe guard 40 may be disposed on at least one of the housing 10 and the clamp 38, and is configured to militate against the occupant stubbing his or her toes on the bed apparatus 2 when the bed 6 is occupied. As a nonlimiting example, the flexible toe guard 40 may include a polymeric strip of material that is attached to one of the housing 10 and the clamp 38 above the closeable vents 24. Suitable types of polymer such as closed cell foam rubbers and the like may be employed within the scope of the present disclosure.

The bed apparatus 2 of the present disclosure also has a power controller 42. In certain examples, the power controller 42 may be disposed on one of a headboard and the footboard 4 of the bed 6. The power controller 42 includes a user interface (not shown) for receiving user inputs. The power controller 42 may optionally include a sensor (not shown) for receiving inputs from a user remotely. The power controller 42 receives power from a power supply such as a D/C power supply, an A/C power supply, and a solar power supply, as nonlimiting examples.

In one embodiment, the power controller 42 is in electrical communication with the at least one electric fan 20, and the power controller 42 is used to selectively control the speed of the electric fan 20. The power controller 42 may also be in electrical communication with an electric actuator of the closeable vent 24, and used to selectively open and close the vent 24. The power controller 42 may be in electrical communication with an at least one thermostatic sensor (not shown) for measuring air temperatures, where the power controller 42 automatically adjusts the speed of the fan 20 and the vent 32 to maintain a temperature.

In operation, power is supplied to the at least one electric fan 20 from the power controller 42. The at least one electric fan 20 is rotated at speeds sufficient to create a negative pressure upstream of the at least one electric fan 20, and a positive pressure downstream of the at least one electric fan 20. The negative pressure causes air to be drawn from the ambient environment outside of the bed 6 through the inlet 28 and into the intake duct 22. The air then passes through the check valve 30 and is pulled through the at least one electric fan 20, where it enters the positive pressure downstream of the at least one electric fan 20.

Once the air passes through the at least one electric fan 20, the positive pressure in the housing 10 forces air to exit the housing 10 through the at least one closeable vent 24 when in the open position. Where a user desires air to be supplied to a sleeping area of the bed 6, the at least one closeable vent 24 is placed in the open position to allow air to be exhausted from the housing 10 through the at least one closeable vent 24, providing both sound-enrichment and the flow of air to the sleeping area of the bed 6. Where a user does not desire air to be supplied to the sleeping area, but wishes to use the system for sound enrichment only, the at least one closeable vent 24 is placed in the closed position to prevent air from passing therethrough.

Where the at least one closeable vent 24 is placed in the closed position, the positive pressure within the housing 10 forces the air to be released through the exhaust port 26 on the outboard surface 14 of the housing 10, thereby providing only sound-enrichment to the sleeping area. It should be appreciated that the exhaust port 26 may have the built-in damper 36, as shown in FIGS. 2 and 5-6, which militates against air flowing through the exhaust port 26 until a sufficient positive pressure is obtained within the housing 10 due to the closing of the at least one closeable vent 24.

It should be appreciated that, in other embodiments, the at least one closeable vent 24 can also be placed in an intermediate or partly closed position. Where the at least one closeable vent 24 is partly closed, air flow through the at least one closeable vent 24 is partially restricted and air flows through both the at least one closeable vent 24 and the exhaust port 26 simultaneously.

Referring now to FIGS. 7-11, a bed apparatus 102 according to another embodiment of the disclosure is shown. The bed apparatus 102 is attached to one side of the footboard 4 for the bed 6. For example, the bed apparatus 102 may be provided in the form of an after-market kit used to upgrade the bed footboard 4. Like or related structure from FIGS. 1-6 that is also shown in FIGS. 7-11 is identified with the same reference number, but in a 100-series, for purpose of clarity.

The bed apparatus 102 includes a housing 110 that is configured to hold the end of the cover 12, such as a sheet or comforter, which is placed on the bed 6. The housing 110 is selectively adjustable from a sound-enrichment-and-bed-air mode to a sound-enrichment-only mode. In the sound-enrichment-and-bed-air mode, the bed apparatus 102 provides both air under the cover 12 and the comforting level of background- or white-noise to the occupant of the bed 6. In the sound-enrichment-only mode, the bed apparatus 102 provides only the comforting level of background- or white-noise to the occupant of the bed 6 without also providing the air under the cover 12.

Figure 8:
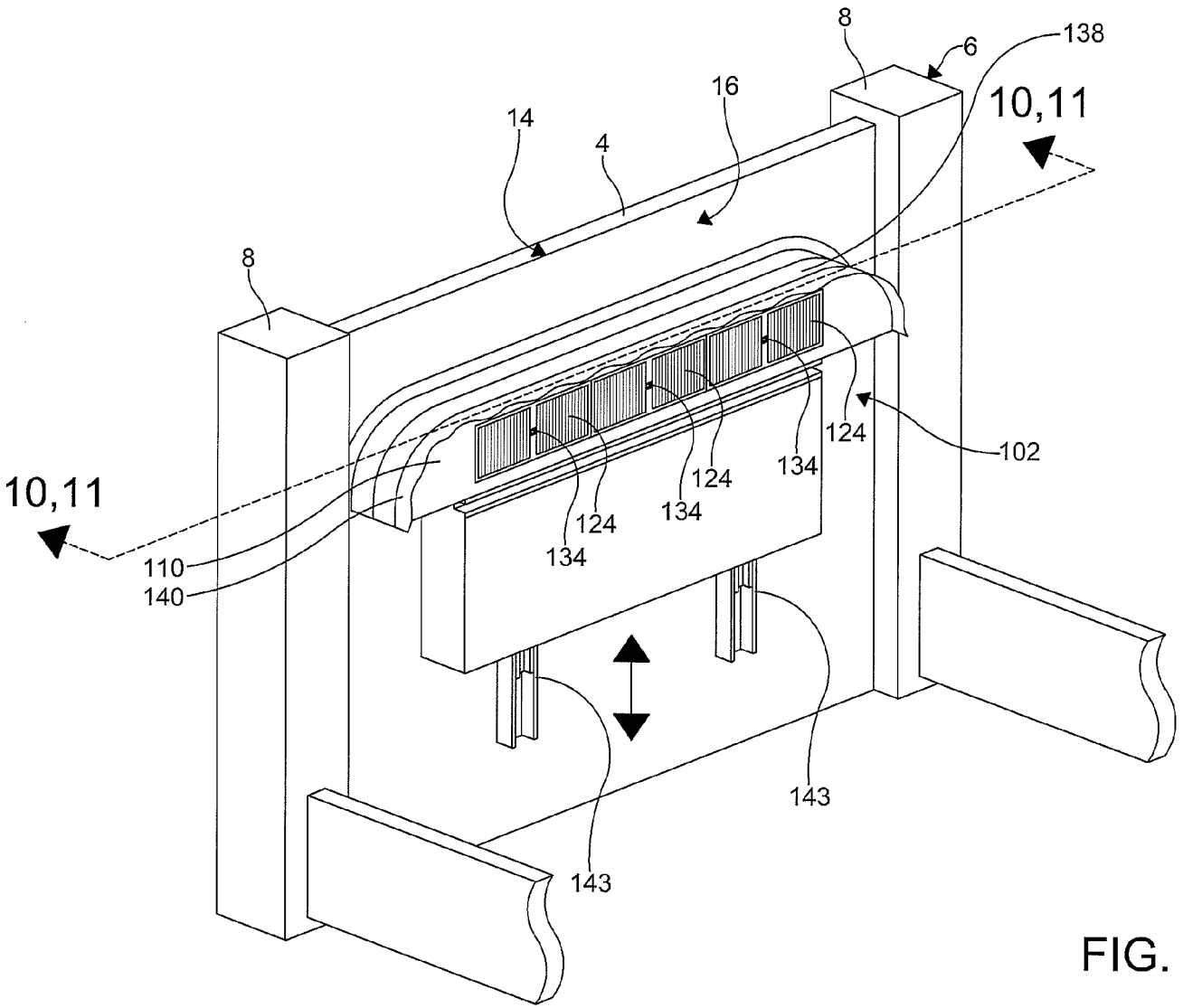
FIG. 8 is a front perspective view of the bed apparatus shown in FIG. 7, the housing shown without the lower air pressure seal to expose the underlying channel, and the housing disposed in a raised position.

The housing 110 may be attachable to the footboard 4 of the bed 6 with at least one slidable rail 143. The at least one slidable rail 143 may involve cooperating or telescoping rail parts, with one of the rail parts attached to the inboard surface 16 of the footboard 4 with a suitable fastener such as screw, bolts, clamps, or the like, and the other of the rail parts being attached to the housing 110 with another suitable fastener. Advantageously, the slidable rail 143 permits a height adjustment of the housing 110 relative to the bed 6. For example, the housing 110 may be adjusted to a raised position such as shown in FIG. 8, which can facilitate a changing of the bed cover 12 on the bed 6. Other means for permitting a height adjustment of the housing 110 relative to the bed 6, such as telescoping rods or pulleys as non-limiting examples, may also be employed as desired.

The housing 110 of the present disclosure defines an air flow passage 118 that is disposed adjacent the inboard surface 16 of the footboard 4. The air flow passage 118 permits a selective flow of air to the occupant of the bed 6 where the bed apparatus 102 is operated in the sound-enrichment-and-bed-air mode.

Figure 9:
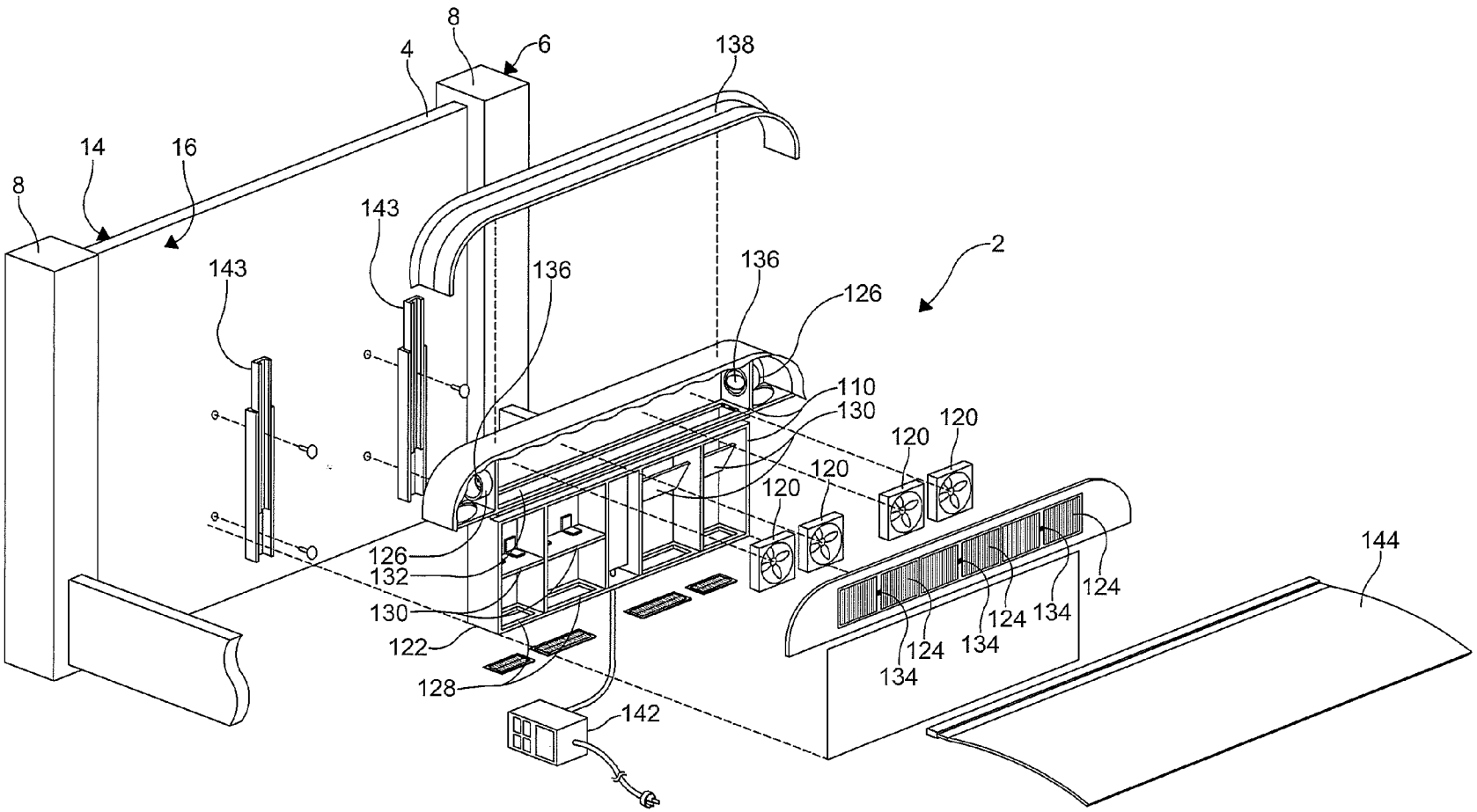
FIG. 9 is an exploded front perspective view of the bed apparatus shown in FIGS. 7-8.
Figure 10:
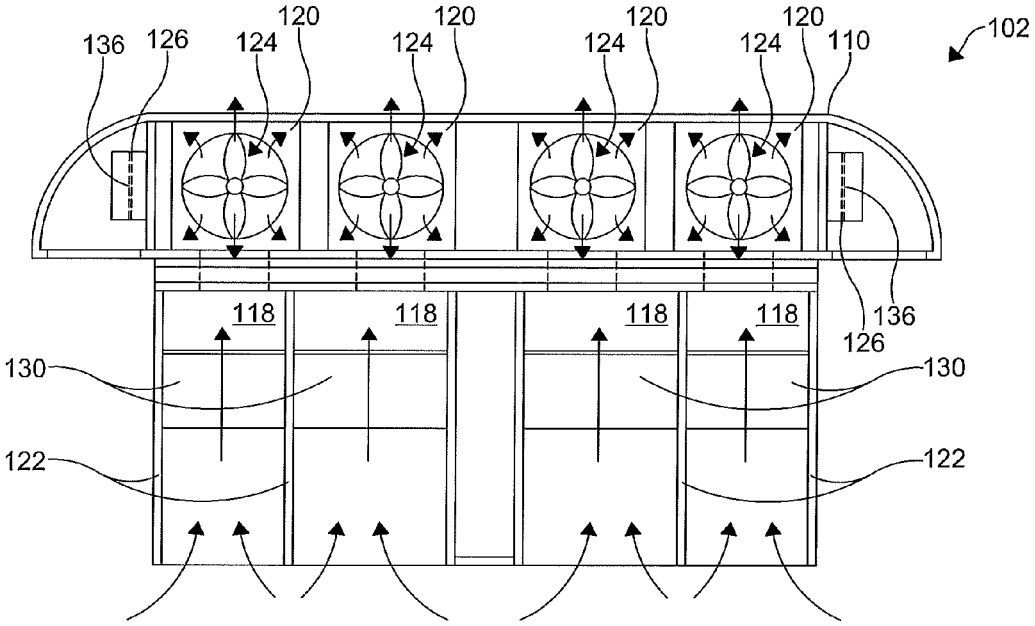
FIG. 10 is a side elevational cross-sectional view of the bed apparatus taken along section line 10,11-10,11 in FIG. 8, and depicting with arrowed lines the air flow through the bed apparatus in a sound-enrichment-and-bed-air mode.
Figure 11:
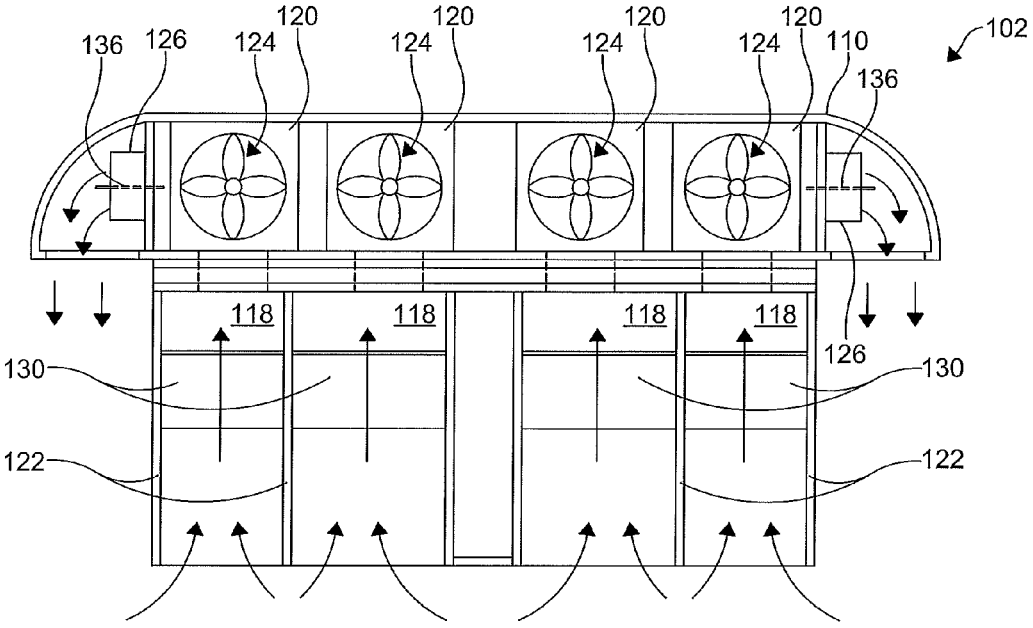
FIG. 11 is a side elevational cross-sectional view of the bed apparatus taken along section line 10,11-10,11 in FIG. 8, and depicting with arrowed lines the air flow through the bed apparatus in a sound-enrichment-only mode.

As shown in FIGS. 9-11, the housing 110 also contains at least one electric fan 120 configured to cause the air flow through the air flow passage 118 when in operation. The electric fan 120 is disposed in the air flow passage 118 of the housing 110. The electric fan 120 is not noiseless, and is selected to provide an aesthetically pleasing level of background- or white-noise. The acceptable noise intensity provided by the electric fan 120 may be between about 10 and 50 decibels, more particularly between about 20 and 40 decibels, and most particularly about 30 decibels. One of ordinary skill in the art may select suitable placement and types of the electric fan 120, within the scope of the present disclosure.

With renewed reference to FIGS. 7-11, the housing 110 of the bed apparatus 102 of the present disclosure has an intake duct 122, a closeable vent 124, and an exhaust port 126. The intake duct 122 is configured to intake air from an area outside of the bed 6, for example, the ambient atmosphere underneath the bed 6. The closeable vent 124 is configured to selectively supply the air to the bed 6. The exhaust port 126 is configured to selectively return the air to the area outside of the bed 6.

As shown in FIGS. 9-11, the intake duct 122 of the present disclosure has an inlet 128 that is formed at a base of the housing 110 on the same side as the outboard surface 116 of the footboard 4. The air flow conduit 118 may include a plurality of independent intake ducts 122, each intake duct 122 having a unique inlet 128 formed in the base of the housing 10. It should also be appreciated that, in an alternative embodiment not shown, a plurality of intake ducts 122 may be in fluid communication with a single inlet 124, as desired.

In the illustrated embodiment of FIGS. 1-6, each of the inlets 128 has a substantially downward orientation. The downward orientation of the inlet 128 advantageously conceals the inlet 128 from potential obstructions, thereby allowing air flow to pass through the inlet 128 uninterrupted. However, it should be understood that the inlet 128 may be oriented in any suitable manner to provide communication of air to the air flow passage 118 of the housing 110, as desired. Each of the inlets 128 of the intake ducts 122 may be covered with a grate, for example, to further militate against undesirable materials being drawn into the intake ducts 122 and damaging the bed apparatus 102.

Referring to FIGS. 9-11, the intake duct 122 may further have a check valve 130 disposed therein. The check valve 130 militates against a reverse flow of air toward the inlet 128 of the intake duct 122 from the electric fan 120 disposed in the air flow passage 118. The check valve 130 allows unidirectional airflow therethrough, wherein air can flow from the inlet 128 to the electric fan 120, but cannot flow from the electric fan 120 to the inlet 128. As a nonlimiting example, shown in FIG. 9, the check valve 130 may be a hinged plate disposed inside of the intake duct 122. Where the hinged plate is seated, as shown on the left side of the housing 110 in FIG. 9, the air does not flow from the inlet 128 to the electric fan 120. Where the hinged plate is unseated, as shown on the right side of the housing 110 in FIG. 9, the air is permitted to flow from the inlet 1280 to the electric fan 120. Any other suitable type of check valve 130 may also be employed, as desired.

In a particular embodiment shown in FIGS. 9-11, the electric fan 120 is positioned downstream of the inlet 128 of the intake duct 122. For example, the electric fan 120 is disposed adjacent an outlet 132 of the intake duct 122. The electric fan 120 may cover the outlet 132 of the intake duct 122 and draw or pull air through the intake duct 122. Where the electric fan 120 is positioned thusly, the check valve 130 may likewise be disposed between the inlet 128 and the electric fan 120. It should be appreciated that other locations for the electric fan 120 and the check valve 130 in the air flow passage 118 of the housing 110 may also be employed, as desired.

Figure 7:
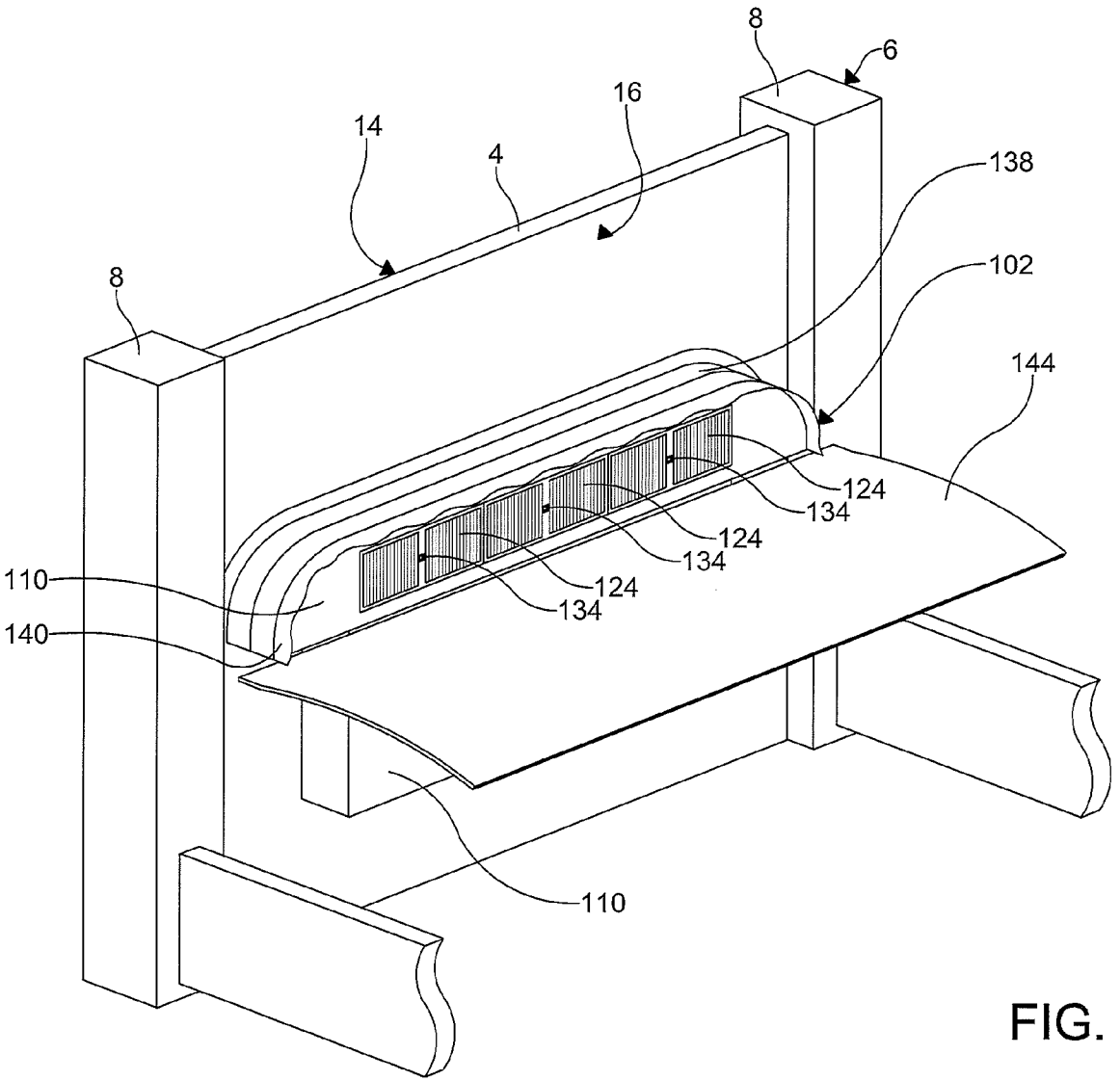
FIG. 7 is a front perspective view of a bed apparatus according to another embodiment of the present disclosure, the bed apparatus depicted attached to an inboard surface of a footboard of a bed, and further having a lower air pressure seal attached to the housing.

As shown in FIGS. 7-8, the closeable vent 124 of the present disclosure is disposed adjacent the inboard surface 16 of the footboard 4 of the bed 6. The closeable vent 124 may have a switch 134 for selectively opening and closing the closeable vent 124. The switch 134 may be a lever or dial for moving the closeable vent 124 to one of the open position and the closed position by manual movement thereof. For example, the closeable vent 124 may be a louvered grate. In another example, the closeable vent 124 may be a pair of slidable plates with openings that may be transitioned into, and out of, alignment by a lateral movement of one of the plates relative to the other of the plates. In a further example, the closeable vent 124 may be connected to an actuator such as an electric motor, which can be manually operated by means of the electric switch 134. Other suitable types of closeable vents 124 and switches 134 may also be used by a skilled artisan within the scope of the disclosure.

Referring now to FIGS. 9-11, the exhaust port 126 of the disclosure has an outlet 133 disposed at an end of the housing 110. The outlet 133 may also be disposed adjacent to the inboard surface 14 of the footboard 4 of the bed 6, and be downwardly oriented relative to the housing 110 so as to exhaust the air toward a base of the bed 6.

The exhaust port 126 may further have a damper 136 disposed therein. The damper 136 militates against a flow of air through the exhaust port 126 where the closeable vent 124 is in the open position, and permits the flow of air through the exhaust port 126 where the closeable vent 124 is in the closed position. The structure of the damper 136 may be the same as, similar to, or different from the structure of the check valve 130. For example, the damper 136 may be a plate or damper valve rotatably disposed inside of the exhaust port 126. One of ordinary skill in the art may select suitable types of dampers 136, as desired.

In particular embodiments, a pair of the exhaust ports 126 (one disposed at each end of the housing 110) are in fluid communication with a plurality of the intake ducts 122, and also with a plurality of the closeable vents 124. The closeable vents 124 are configured to expel air away from the inboard surface 16 of the footboard 4, and toward the bed occupant, when in an open position. The open position of the closeable vents 124 thereby places the bed apparatus 102 in the sound-enrichment-and-bed-air mode while the at least one electric fan 120 is operating, for example, as shown in FIG. 10. Advantageously, where the closeable vents 124 are in a closed position, the exhaust ports 126 are configured to expel air away from the from the bed occupant. The closed position of the closeable vents 124 thereby places the bed apparatus 102 in the sound-enrichment-only mode while the at least one electric fan 120 is operating, for example, as shown in FIG. 11.

The bed apparatus 102 of the present disclosure is also configured to efficiently deliver and direct the air from the bed apparatus 102 to the occupant of the bed 6, by holding the bed cover 12 in place above the closeable vents 124. In particular, the bed apparatus 102 may have a clamp 138 for holding the end of the bed cover 12. The clamp 138 may be disposed above the housing 110. In one example, illustrated in FIGS. 7-9, the clamp 138 may be in the form of a clamp board that conforms substantially to the shape of the upper surface of the housing 110. In operation, the end of the bed cover 12 is disposed between the clamp board and the upper surface, and is held firmly in place by friction fit between the clamp board and the housing 110. Other fasteners such as screw, bolts, pins, or the like may also be employed to secure the clamp board to the housing 110 of the disclosure.

In other examples, the clamp 138 is provided in the form of spring-loaded clips (not shown) attached to the upper surface of the housing 110. The spring-loaded clips may be biased toward the upper surface so that the end of the bed cover 12 may be held securely in place by the clips. In further examples, the clamp 138 is provided in the form of a C-channel (not shown) that has a friction fit with a rib (not shown) formed on the upper surface of the housing. The end of the bed cover 12 may also be disposed between the C-channel and the rib in order to hold the end of the bed cover 12 in place on the housing 110. One of ordinary skill in the art may also select other suitable structures for holding the end of the bed cover 12 on the housing 110 above the closeable vents 124, as desired.

With renewed reference to FIGS. 7-9, the bed apparatus 102 may further have a flexible toe guard 140. The flexible toe guard 140 may be disposed on at least one of the housing 110 and the clamp 138, and is configured to militate against the occupant stubbing his or her toes on the bed apparatus 102 when the bed 6 is occupied. As a nonlimiting example, the flexible toe guard 140 may include a polymer strip of material that is attached to one of the housing 110 and the clamp 138 above the closeable vents 124. Suitable types of polymer such as closed cell foam rubbers and the like may be employed within the scope of the present disclosure.

The bed apparatus 102 of the present disclosure also has a power controller 142. In certain examples, the power controller 142 may be connected by wiring to the electric fans 120, for example, through a conduit disposed in the housing 110. The power controller 142 may be disposed adjacent to one of the headboard and the footboard 4 of the bed 6 for use by the occupant. The power controller 142 includes a user interface (not shown) for receiving user inputs. The power controller 142 may optionally include a sensor (not shown) for receiving inputs from a user remotely. The power controller 142 receives power from a power supply such as a D/C power supply, an A/C power supply, and a solar power supply, as nonlimiting examples.

In one embodiment, the power controller 142 is in electrical communication with the at least one electric fan 120, and the power controller 142 is used to selectively control the speed of the electric fan 120. The power controller 142 may also be in electrical communication with an electric actuator of the closeable vent 124, and used to selectively open and close the vent 124. The power controller 142 may be in electrical communication with an at least one thermostatic sensor (not shown) for measuring air temperatures, where the power controller 142 automatically adjusts the speed of the fan 120 and the vent 132 to maintain a temperature.

In operation, power is supplied to the at least one electric fan 120 from the power controller 142. The at least one electric fan 120 is rotated at speeds sufficient to create a negative pressure upstream of the at least one electric fan 120, and a positive pressure downstream of the at least one electric fan 120. The negative pressure causes air to be drawn from the ambient environment outside of the bed 6 through the inlet 128 and into the intake duct 122. The air then passes through the check valve 130 and is pulled through the at least one electric fan 120, where it enters the positive pressure downstream of the at least one electric fan 120.

Once the air passes through the at least one electric fan 120, the positive pressure forces air to exit the housing 110 through the at least one closeable vent 124 when in the open position. Where a user desires air to be supplied to a sleeping area, the at least one closeable vent 124 is placed in the open position to allow air to be exhausted from the housing 110 through the at least one closeable vent 124, providing both sound-enrichment and a flow of air to the sleeping area. Where a user does not desire air to be supplied to the sleeping area, but wishes to use the system for sound enrichment only, the at least one closeable vent 124 is placed in the closed position to prevent air from passing therethrough.

Where the at least one closeable vent 124 is placed in the closed position, the positive pressure within the housing 110 forces the air to be released through the exhaust port 126 on the end of the housing 110, thereby providing only sound-enrichment to the sleeping area. It should be appreciated that the exhaust port 126 may have the built-in damper 136, as shown in FIGS. 10-11, which militates against air flowing through the exhaust port 126 until a sufficient positive pressure is obtained within the housing 110 due to the closing of the at least one closeable vent 124.

It should be appreciated that, in other embodiments, the at least one closeable vent 124 can also be placed in an intermediate or partly closed position. Where the at least one closeable vent 124 is partly closed, air flow through the at least one closeable vent 124 is partially restricted and air flows through both the at least one closeable vent 124 and the exhaust port 126 simultaneously.

With renewed reference to FIG. 7, the bed apparatus 102 of the present disclosure may also have a lower air pressure seal 144. Although the lower air pressure seal 144 is shown in the embodiments of FIGS. 7-11, it should be appreciated that the lower air pressure seal 144 may also be used with the embodiments of FIGS. 1-6, as desired.

The lower air pressure seal 144 may be attached to the housing 110 below the closeable vent 124, for example. In particular embodiments, the lower air pressure seal 144 is a polymer blanket or mat that is disposed along substantially an entire length of the housing 110. For example, the lower air pressure seal 144 may be disposed in a channel formed in the housing 110, which permits the lower air pressure seal 144 to be removed for cleaning as necessary. The occupant of the bed 6 can rest his or her feet on the lower air pressure seal 144. It should be understood that the lower air pressure seal 144, where used in conjunction with the clamp 138 that holds the bed cover 12 above the closeable vent 124, facilitates an efficient delivery of the air to the occupant of the bed 6, with minimal loss of the air to the area outside of the bed 6.

The bed apparatus 2, 102 of the present disclosure may also be provided with other features that encourage a positive sleep cycle for the occupant of the bed 6. For example, the bed apparatus 2, 102 may have at least one light (not shown) that is disposed on the housing 10, 110. The at least one light may selectively provide both a blue-light and an orange-light. In certain embodiment, the bed apparatus 2, 102 may have a timer that turns on the blue-light effect during morning hours, when the occupant desires to be awoken from sleep. The time may also turn on the orange-light effect during evening hours, when the occupant desires to begin sleeping. It should be appreciated that these features, when used in combination with the bed apparatus 2, 102 in either the sound-enrichment-and-bed-air mode or the sound-enrichment-only mode, may facilitate a positive sleeping experience for the occupant of the bed 6.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A bed apparatus, comprising:

a housing with a first intake duct and a second intake duct, each of the first intake duct and the second intake duct configured to intake air into the housing from an area outside of a bed, the housing also having a closeable vent configured to selectively supply the air to the bed, and the housing further having an exhaust port configured to selectively return the air to the area outside of the bed, the exhaust port arranged adjacent an end of the housing and spaced apart from the closeable vent;

a damper disposed in the exhaust port, the damper militating against a flow of air through the exhaust port where the closeable vent is in an open position, and permitting the flow of air through the exhaust port where the closeable vent is in a closed position;

a first electric fan and a second electric fan, the first electric fan disposed within the housing adjacent to the first intake duct, and the second electric fan disposed within the housing adjacent to the second intake duct, each of the first electric fan and the second electric fan selectively providing a noise intensity between about 10 and 50 decibels; and a first check valve and a second check valve, the first check valve disposed in the first intake duct between the first electric fan and an inlet of the first intake duct, and the second check valve disposed in the second intake duct between the second electric fan and an inlet of the second intake duct, each of the first check valve and the second check valve militating against a reverse flow of the air toward the inlets where one of the first electric fan and the second electric fan is not operated, wherein a positive internal pressure is generated in the housing by at least one of the first electric fan and the second electric fan, which forces the flow of air to exit the housing through the closeable vent where the closeable vent is in the open position, and to exit the housing through the exhaust port where the closeable vent is in the closed position, and wherein the housing is selectively adjustable from a sound-enrichment-and-bed-air mode where the closeable vent is in the open position and the air is expelled through the closeable vent to the bed, to a sound-enrichment-only mode where the closeable vent is in the closed position and air is expelled through the exhaust port away from the bed.

2. The bed apparatus of claim 1, further comprising a clamp disposed above the housing and configured to hold an end of a cover on the bed above the closeable vent.

3. The bed apparatus of claim 2, wherein at least one of the the clamp and an upper portion of the housing adjacent to the clamp further includes a flexible toe guard.

4. The bed apparatus of claim 3, wherein the flexible toe guard is a polymeric strip of material disposed above the closeable vent.

5. The bed apparatus of claim 1, further comprising a power controller in electrical communication with the first electric fan and the second electric fan, the power controller used to selectively and individually control a speed and thereby the noise intensity of the first electric fan and the second electric fan.

6. The bed apparatus of claim 1, wherein there is no conduit other than the housing providing fluid communication between the first intake duct and each of the closeable vent and the exhaust port, and there is no conduit other than the housing providing fluid communication between the second intake duct and each of the closeable vent and the exhaust port.

7. The bed apparatus of claim 1, wherein the closeable vent includes has a switch for selectively opening and closing the closeable vent.

8. The bed apparatus of claim 1, further comprising a lower air pressure seal attached to the housing below the closeable vent.

9. The bed apparatus of claim 8, wherein the lower air pressure seal is a polymer blanket disposed along an entire length of the housing.

10. The bed apparatus of claim 9, wherein the lower air pressure seal is removably disposed in a channel formed in the housing.

11. The bed apparatus of claim 1, wherein the housing is disposed through a footboard of the bed.

12. The bed apparatus of claim 11, wherein the intake duct has a downwardly oriented inlet disposed adjacent an outboard surface of the footboard, and the closeable vent is disposed adjacent an inboard surface of the footboard.

13. The bed apparatus of claim 12, wherein the exhaust port has an outlet disposed adjacent the outboard surface of the footboard.

14. The bed apparatus of claim 1, wherein the housing is configured for attachment to an inboard surface of a footboard of the bed.

15. The bed apparatus of claim 14, wherein the housing is attached to least one slidable rail that permits a height adjustment of the housing relative to the bed.

16. The bed apparatus of claim 14, wherein each of the first intake duct and the second intake duct is formed at a base of the housing, and the closeable vent is disposed adjacent an inboard surface of the footboard.

17. The bed apparatus of claim 16, wherein the exhaust port has a downwardly oriented outlet disposed at an end of the housing and adjacent the inboard surface of the footboard.

* * * * *